US006298630B1

(12) United States Patent
VeRost et al.

(10) Patent No.: US 6,298,630 B1
(45) Date of Patent: Oct. 9, 2001

(54) WALL PLATE FOR ATTACHING BEAMS TO MASONRY WALLS

(76) Inventors: Russell L. VeRost, 780 Thomas Fox Dr. West, North Tonawanda, NY (US) 14120; Martin A. VeRost, Sr., 400 West Ave., Unit G4, West Seneca, NY (US) 14224

( * ) Notice: Subject to any disclaimer, the term of this patent is extended or adjusted under 35 U.S.C. 154(b) by 0 days.

(21) Appl. No.: 09/573,586

(22) Filed: May 18, 2000

(51) Int. Cl.[7] ..... E04B 1/38; E04C 5/00

(52) U.S. Cl. ..... 52/712; 52/698; 52/656.9; 52/655.1; 52/105; 52/645; 52/251; 52/252; 52/699; 52/702; 52/714

(58) Field of Search ..... 52/698, 656.9, 52/655.1, 105, 645, 251, 252, 699, 702, 712, 714

(56) References Cited

U.S. PATENT DOCUMENTS 3,837,135 * 9/1974 Zachman ..... 52/702
4,528,791 * 7/1985 Enssle ..... 52/699
5,603,580 * 2/1997 Leek ..... 52/702
5,956,916 * 9/1999 Liss ..... 52/655.1

* cited by examiner

*Primary Examiner*—Carl D. Friedman
*Assistant Examiner*—Chi Nguyen
(74) *Attorney, Agent, or Firm*—Richard D. Fuerle

(57) ABSTRACT

A wall plate for attaching a horizontal or sloping beam to a vertical or nearly vertical masonry wall is disclosed. The wall plate comprises a flat plate having a multiplicity of nail holes and at least two bolt holes therethrough, at least one anchor extending from a first side of the flat plate and fixed to it, and means for threadedly attaching at least two bolts to the flat plate from its other side.

A method of attaching a horizontal or sloping beam to a vertical or nearly vertical masonry wall using the wall plate is also disclosed. A vertical nailable form is erected and the wall plate is nailed to the inside of the form. Concrete is poured into the form to a height above the anchors of the wall plate. After the concrete has hardened, the forms are removed. Two angle connectors are bolted to the wall plate and a horizontal or sloping beam is bolted to the two angle connectors.

21 Claims, 2 Drawing Sheets

WALL PLATE FOR ATTACHING BEAMS TO MASONRY WALLS

BACKGROUND OF THE INVENTION

This invention relates to a wall plate for attaching a horizontal beam to a vertical masonry wall. In particular, it relates to a threaded wall plate that is nailed to the inside of a wood form into which concrete is poured so that steel beams can be bolted to it when the concrete hardens and the form has been removed.

In the construction of commercial buildings, it is common practice to pour concrete between vertical wood forms to make the walls. Steel plates having anchors extending inward are nailed to the inside of the forms and, when the concrete has been poured and has hardened, become imbedded in the wall. Steel beams are held against these plates, either by scaffolding or by a crane, and the beams are welded to the plates.

This method of attaching the beams to the walls is time-consuming as it can be difficult to hold the beam in the required position until the welding is completed. It can also be dangerous if the scaffolding or crane slips or moves. When the building is finished, the welds are hidden by the interior structures of the building and can no longer be easily accessed for inspection. If moisture condenses on the welds, they can corrode and weaken.

SUMMARY OF THE INVENTION

We have discovered that steel beams can be attached to masonry walls easily and quickly by anchoring a threaded wall plate into the masonry wall. In this invention, a wall plate is nailed to the inside of the wooden form in a position aligned with the beam to be attached to it. The anchors of the wall plate extend inward, fixing the plate to the concrete once it has been poured and has hardened. The beam is brought into position and is bolted to the plate. No welding is required to attach the beam to the wall. The wall plate of this invention can be used without cutting or drilling the forms used to hold the concrete.

DESCRIPTION OF THE PREFERRED EMBODIMENTS

Figure 2:
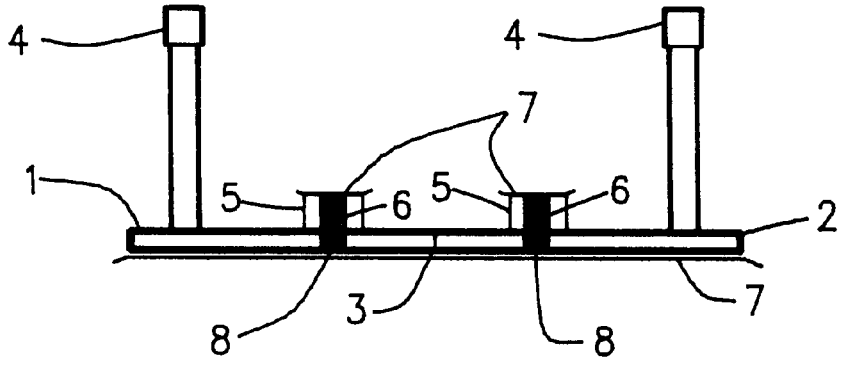
FIG. 2 is a top view of the wall plate shown In FIG. 1.
Figure 3:
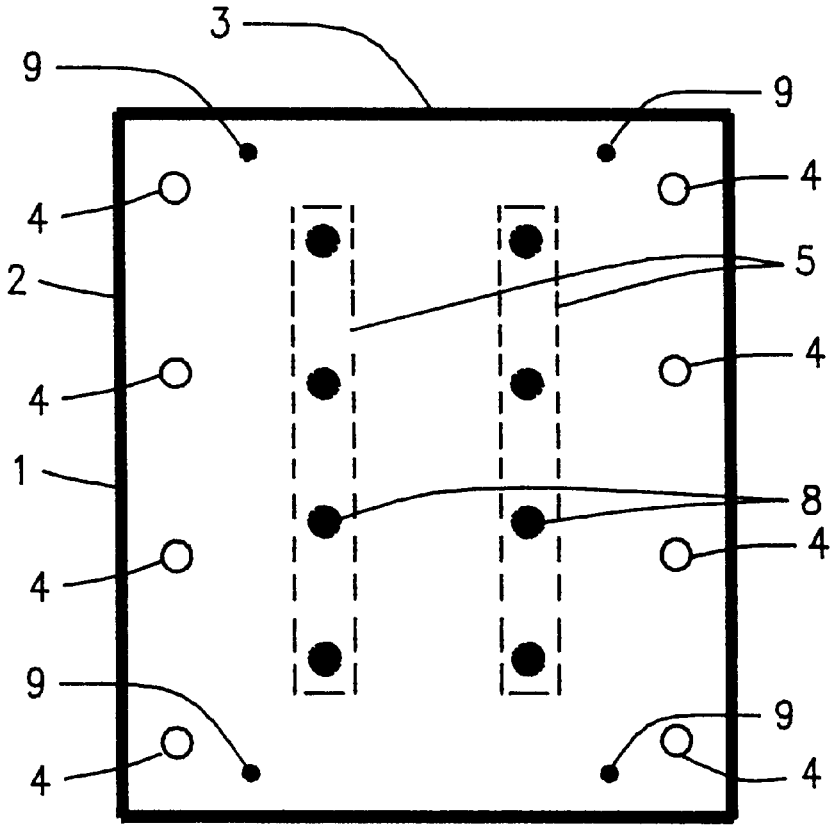
FIG. 3 is a front view of the wall plate shown in FIG. 1.

In FIGS. 2 and 3, a wall plate 1 according to this invention has a flat plate 2 with a mark 3 at its top center. A number of anchors 4 have been welded to flat plate 2. Also welded to flat plate 2 are two parallel nut bars 5, each, having four spaced threaded holes 6 therethrough. The holes 6 on each nut bar 5 are equidistant from the center of flat plate 2, as indicated by mark 3. Adhesive sheets 7 cover the inside of threaded holes 6 to prevent concrete from entering and the face of flat plate 2 to keep its surface free of concrete. Threaded holes 6 are aligned with slightly larger unthreaded bolt holes 8 in flat plate 2. In addition, there are a number of nail holes 9 through flat plate 2.

Figure 1:
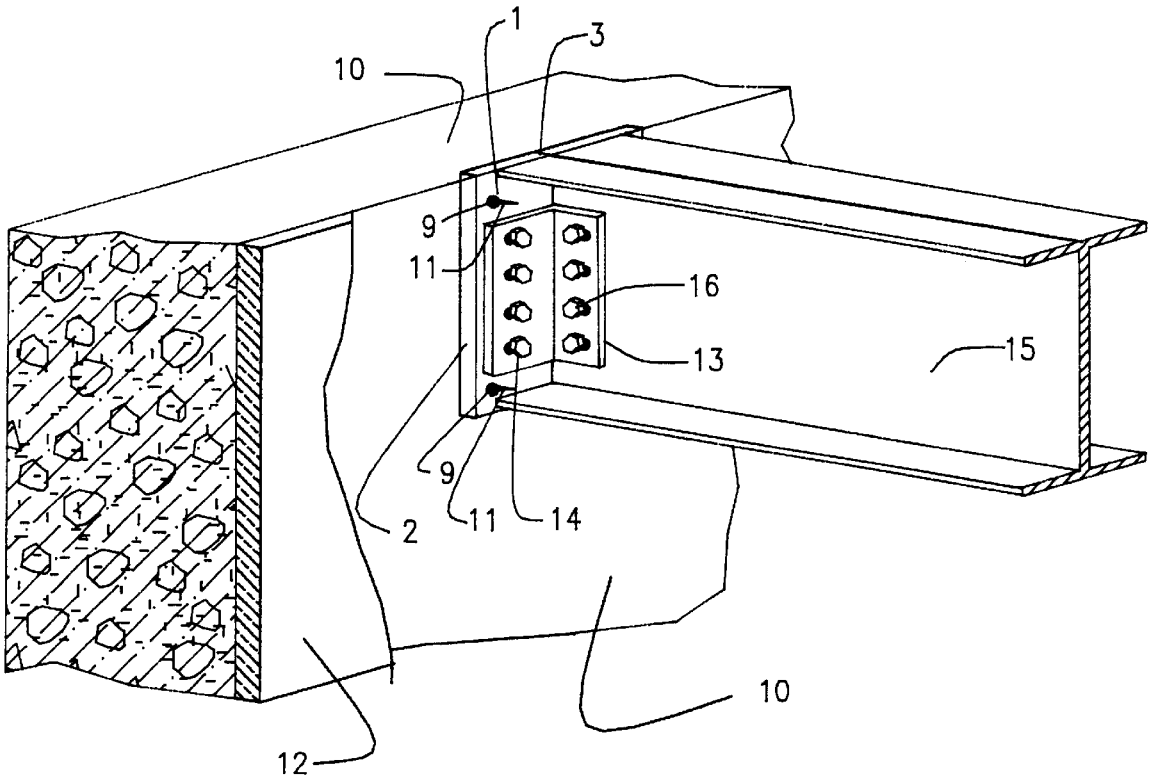
FIG. 1 is an isometric view showing a wall plate according to this invention imbedded in a concrete wall and having a steel beam bolted to it.

Referring now also to FIG. 1, wall plate 1 is fixed to vertical concrete wall 10 by means of its anchors 4, which became imbedded in concrete wall 10 after the concrete had been poured and had hardened. Nails 11 pulled away from form 12 (partially shown), which holds the concrete until it hardens; form 12 is then removed. Two right-angle connectors 13 (only one shown) are loosely bolted to flat plate 2 by screwing bolts 14 through holes 8 and 6. One connector 13 is on each side of horizontal steel beam 15, which is fastened to connectors 13 by bolts 16, which pass through slots (not shown) in steel beam 15.

While wall plate 1 can be made of a variety of materials, such as metals, plastics, or other materials, it is preferably made of steel as that is the most appropriate material for this application. Various grades of steel can be used, including ASTM A-572-GR50, ASTM A-36, ASTM A-529, ASTM A-441, ASTM A572 GR42, ASTM A-572-GR60, ASTM A-572 GR65, ASTM A242, ASTM A588, ASTM A852, ASTM A514, ANSI 1015, ANSI 1020, ANSI 1025, ANSI 1045, ANSI 1045 FINELINE, ANSI 1060 FH "62," ANSI 1060, and ASTM A-9. Flat plate 1 can have any suitable shape or size, but is preferably rectangular and is about 10 to about 17 inches wide, about 6 to about 37 inches long, and about 0.75 to about 1.5 inches thick.

Anchors 4 are preferably fixed to flat plate 2 by welding, but could also be fixed by other means, or they could be formed by bending a partially cut out portion of flat plate 2 at a right angle. Anchors 4 can have any appropriate size and shape, selected to prevent them from pulling out of wall 10 or cracking or damaging wall 10. They can be headed or bent reinforcing rods or bent bars, as desired. Preferably, they are headed shear connectors about 3 to about 12 inches long and about 0.75 to about 1.5 inches in diameter. Any number of anchors can be used, depending upon the size of the beam to be supported and other conditions; preferably, about 2 to about 12 anchors are used.

It is preferable to use threaded nuts or nut bars to hold bolts 14 to wall plate 1, but it is also possible to use threaded holes in flat plate 2. If nuts or nut bars are used, they are preferably welded to flat plate 2, but could be fastened by other means as well. Nuts can also be welded inside holes in flat plate 2. The side of flat plate 2 that is against form 12, however, should not have projections extending beyond plate 2, so that plate 2 completely touches form 12.

The number of bolts 14 required depends upon the size of beam 15, but usually about 2 to about 20 bolts about 0.625 to about 1.5 inches in diameter are adequate. Bolts 14 are preferably made of ASTM A-307, ASTM A325, ASTM A490 steel, but can also be made of other materials and can be galvanized, cadmium plated, powder coated, or clean metal.

Adhesive sheet 7 can be made of a variety of materials, such as polyethylene, polypropylene, polycarbonate, paper, etc. Forms 12 (see FIG. 1) can be made of wood, composite, or other material that can be nailed and can be vertical or sloped. Steel beam 15 is usually at 90° to wall 10, but it can also be at another angle using connectors 13 that are bent at that angle. Steel beam 15 is usually horizontal, but can also be sloping, using connectors made to fit.

To use the wall plate of this invention, the vertical forms 12 (see FIG. 1) are erected and wall plates 1 are nailed to the inside of forms 12 at the correct positions for beams 15. Marks 3 can be used as a guide, with the top of wall plates 1 even with the top of beams 15. Concrete is poured into the forms to a height that at least covers anchors 4. After the concrete has hardened, forms 12 and adhesive sheet 7 (see FIG. 2) are removed from the front of flat plate 2, leaving wall plate 1 fixed flush with vertical concrete wall 10. Connectors 13 can be first bolted to beam 15, but it is preferable to first bolt them loosely to wall plate 1. Beam 15 is then moved into position using, for example, a crane, and bolts 16 are inserted and all the bolts are tightened.

We claim:

1. A wall plate comprising (A) a flat plate having a multiplicity of nail holes and at least two bolt holes therethrough;

(B) at least one anchor extending from a first side of said flat plate and fixed thereto; and (C) means welded to said first side of said flat plate having at least two threaded apertures therethrough, each bolt hole aligned with an aperture.

2. A wall plate according to claim 1 wherein said means is at least two nuts.

3. A wall plate according to claim 1 wherein said means is at least two nut bars.

4. A wall plate according to claim 1 wherein there are about 2 to about 12 of said anchors and each anchor is a headed shear connector about 3 to about 12 inches long and about 0.75 to about 1.5 inches in diameter.

5. A wall plate according to claim 1 wherein said means is covered by an adhesive sheet on said first side and an adhesive sheet covers said flat plate on said other side.

6. A wall plate according to claim 1 wherein said bolts are galvanized, cadmium plated, powder coated, or clean metal.

7. A wall plate according to claim 1 made of steel.

8. A wall plate according to claim 1 wherein said flat plate is a rectangle about 10 to about 17 inches wide, about 6 to about 37 inches long, and about 0.75 to about 1.5 inches thick.

9. A wall plate according to claim 1 wherein said flat plate has a mark on top at its center.

10. A wall plate according to claim 3 having 2 bolt holes and 2 nut bars.

11. A structure comprising (A) a nailable form; and (B) at least one wall plate according to claim 1 nailed to said form through said nail holes.

12. A support structure for a building comprising (A) a masonry wall; and (B) a wall plate according to claim 1 molded into said wall, with said anchors within said wall and said flat plate flush with a surface of said wall.

13. A structure according to claim 12 including two angle connectors bolted to said means with steel bolts.

14. A structure according to claim 13 wherein said bolts are made of ASTM A307, ASTM A325, or ASTM A490 steel.

15. A structure according to claim 13 wherein said bolts are galvanized, cadmium plated, powder coated, clean metal.

16. A method of attaching a beam to a vertical masonry wall comprising (A) erecting a nailable form;

(B) nailing a wall plate according to claim 1 to the inside of said form;

(C) pouring concrete into said form to a height above said anchors;

(D) removing said nailable form after said concrete has hardened;

(E) bolting two angle connectors to said wall plate; and (F) bolting said beam to said two angle connectors.

17. A wall plate comprising (A) a flat steel plate having a multiplicity of nail holes and 2 to 20 bolt holes therethrough;

(B) at least two steel anchors welded to a first side of said flat plate;

(C) two parallel nut bars, each having at least one threaded hole therethrough aligned with one of said bolt holes, welded to said first side of said flat plate; and (D) adhesive sheets covering the opening of said threaded holes on said first side of said flat plate and said bolt holes on the other side of said flat plate.

18. A wall plate according to claim 17 wherein said flat steel plate has a mark centered on top.

19. A wall plate comprising (A) a flat steel plate about 10 to about 17 inches wide and about 6 to about 37 inches long, having a multiplicity of nail holes and about 2 to about 20 bolt holes therethrough;

(B) about 2 to about 12 steel anchors welded to a first side of said flat plate;

(C) two nut bars, each having at least one threaded hole therethrough that is aligned with one of said bolt holes, where each nut bar is welded to said first side of said flat plate;

(D) adhesive sheets covering the opening of said threaded holes on said first side of said flat plate and said bolt holes on the other side of said flat plate; and (E) a mark on top of said flat plate at its center.

20. A wall plate according to claim 19 wherein said flat plate, said steel anchors, said nut bars or nuts are galvanized, cadmium plated, powder coated, or clean metal.

21. A wall plate according to claim 7 wherein said steel is selected from the group consisting of ASTM A-572-GR50, ASTM A-36, ASTM A-529, ASTM A-441, ASTM A572 GR42, ASTM A-572-GR60, ASTM A-572 GR65, ASTM A242, ASTM A588, ASTM A852, ASTM A514, ANSI 1015, ANSI 1020, ANSI 1025, ANSI 1045, ANSI 1045 FINELINE, ANSI 1060 FH "62," ANSI 1060, and ASTM A-9.

* * * * *